US006324889B1

(12) United States Patent
Fluhrer

(10) Patent No.: US 6,324,889 B1
(45) Date of Patent: Dec. 4, 2001

(54) ULTRASOUND SENSOR FOR A FUMES EXTRACTOR HOOD

(75) Inventor: Henry Fluhrer, Nuremberg (DE)

(73) Assignee: Diehl Stiftung & Co., Nürnberg (DE)

( * ) Notice: Subject to any disclaimer, the term of this patent is extended or adjusted under 35 U.S.C. 154(b) by 0 days.

(21) Appl. No.: 09/438,716

(22) Filed: Nov. 11, 1999

(30) Foreign Application Priority Data

Nov. 11, 1998 (DE) ..... 198 51 884

(51) Int. Cl.[7] ..... F24C 15/20
(52) U.S. Cl. ..... 73/1.82
(58) Field of Search ..... 73/1.82, 1.86, 73/1.06, 23.21, 31.01, 31.02, 31.03, 24.01, 627, 629

(56) References Cited

U.S. PATENT DOCUMENTS 3,967,143 * 6/1976 Watanabe et al. ..... 310/8.1
5,074,281 * 12/1991 Fluhrer et al. ..... 126/299
5,991,234 * 11/1999 Sejalon et al. ..... 367/13

FOREIGN PATENT DOCUMENTS

19510731-A1 * 2/1996 (DE) .
0 443 141 B1 8/1991 (EP) .
603539-A1 * 6/1994 (EP) .

* cited by examiner

*Primary Examiner*—Hezron Williams
*Assistant Examiner*—Rose M. Miller
(74) *Attorney, Agent, or Firm*—Scully, Scott, Murphy & Presser

(57) ABSTRACT

Provided is to an ultrasound sensor for a fumes extractor hood, wherein the sensor monitors the vapor rising from the cooking to the extractor hood. Automatic compensation in respect of temperature and ageing drift of the sensor is effected. For that purpose checking of the resonance frequency is implemented cyclically during on-going operation of the sensor, in which case a shift in the resonance frequency is recognized, and the new resonance frequency is established by a statistical calculation method and used for further operation of the sensor.

8 Claims, 2 Drawing Sheets

ULTRASOUND SENSOR FOR A FUMES EXTRACTOR HOOD

BACKGROUND OF THE INVENTION

1. Field of the Invention

The invention relates to an ultrasound sensor for a fumes extractor hood with automatic compensation in respect of temperature and ageing drift, wherein the ultrasound sensor comprising a transmitter and a receiver monitors the vapour rising from the cooking to the fumes extractor hood and wherein the ultrasound sensor has a system-specific resonance frequency.

2. Discussion of the Prior Art

It is known from EP 0 443 141 B1 to use ultrasound sensors for controlling the fan in fumes extractor hoods. That involves taking advantage of the realisation that the rising vapours alter the amplitude of the ultrasound signal, more specifically, the amplitude of the ultrasound signal being altered to an increasing degree in proportion to increasing vapour formation. It is known in relation to ultrasound sensors for temperature drift to be automatically compensated, but hitherto there were no indications as to how the ageing drift of the sensor is compensated during on-going operation of the ultrasound sensor. Ageing drift results in a change in the resonance frequency of the sensor and therefore has to be monitored. Hitherto the necessary compensation effect is possible only in regard to a calm-air signal section and hitherto a strict association between sensor and associated electronics was also necessary as generally compensation could not be effected in the installed condition.

SUMMARY OF THE INVENTION

The object of the present invention is now that of avoiding those disadvantages and proposing an ultrasound sensor having a monitoring circuit which permits automatic compensation in respect of ageing drift during on-going operation of the sensor.

The invention therefore essentially provides that the monitoring circuit operates the ultrasound sensor at predetermined time intervals in succession at different frequencies in a frequency range near the resonance frequency and in so doing establishes the amplitudes which occur at a maximum. A frequency of the sensor is associated with each such maximum and an average frequency f (q) is ascertained from a plurality of such individual frequencies, said average frequency being firstly used as a new resonance frequency f (o). That applies until a fresh compensating test is undertaken. Each such test is effected for a very short time in order not to interfere with on-going operation of the ultrasound sensor in regard to monitoring the vapours. The frequency of the tests is empirically established.

In a preferred further configuration of the invention it is provided that the monitoring circuit, on passing through the frequency band, establishes and stores the frequency values associated with the maximum amplitudes that occur, that the monitoring circuit calculates from the frequency distribution of the respective maximum amplitudes and therewith the frequency values in a statistical calculation procedure the standard deviation and the centre frequency f (q), and that it uses that frequency as the resonance frequency f (o) for operation of the sensor until the next established change in the centre frequency f (q). That statistically calculated centre frequency corresponds to the above-mentioned average frequency and in the best case is equal to the originally predetermined resonance frequency f (o), but is at least in the proximity thereof.

A further preferred embodiment of the invention provides that, to ascertain the standard deviation and the centre frequency f (q), only those frequency values which are at a predetermined frequency spacing relative to the resonance frequency f (o), such as for example ±1 kHz, ±2 kHz, are stored.

A particularly desirable development of the invention provides that the ultrasound sensor includes a transmitter and a receiver in a housing, that it operates alternately in the transmitting and in the receiving mode and in so doing senses the vapour in a reflection procedure.

As an essential component, the monitoring circuit has a microcontroller which on the one hand provides for control of the fan of the extractor hood and which on the other hand provides for automatic drift compensation. This automatic compensation effect also makes it possible to compensate for temperature drift in the same testing cycle so that there is no need to involve separate complication and expense for same.

BRIEF DESCRIPTION OF THE DRAWINGS

The invention will be described in greater detail hereinafter by means of an embodiment. In the drawing.

DETAILED DESCRIPTION OF THE PREFERRED EMBODIMENTS

Figure 1:
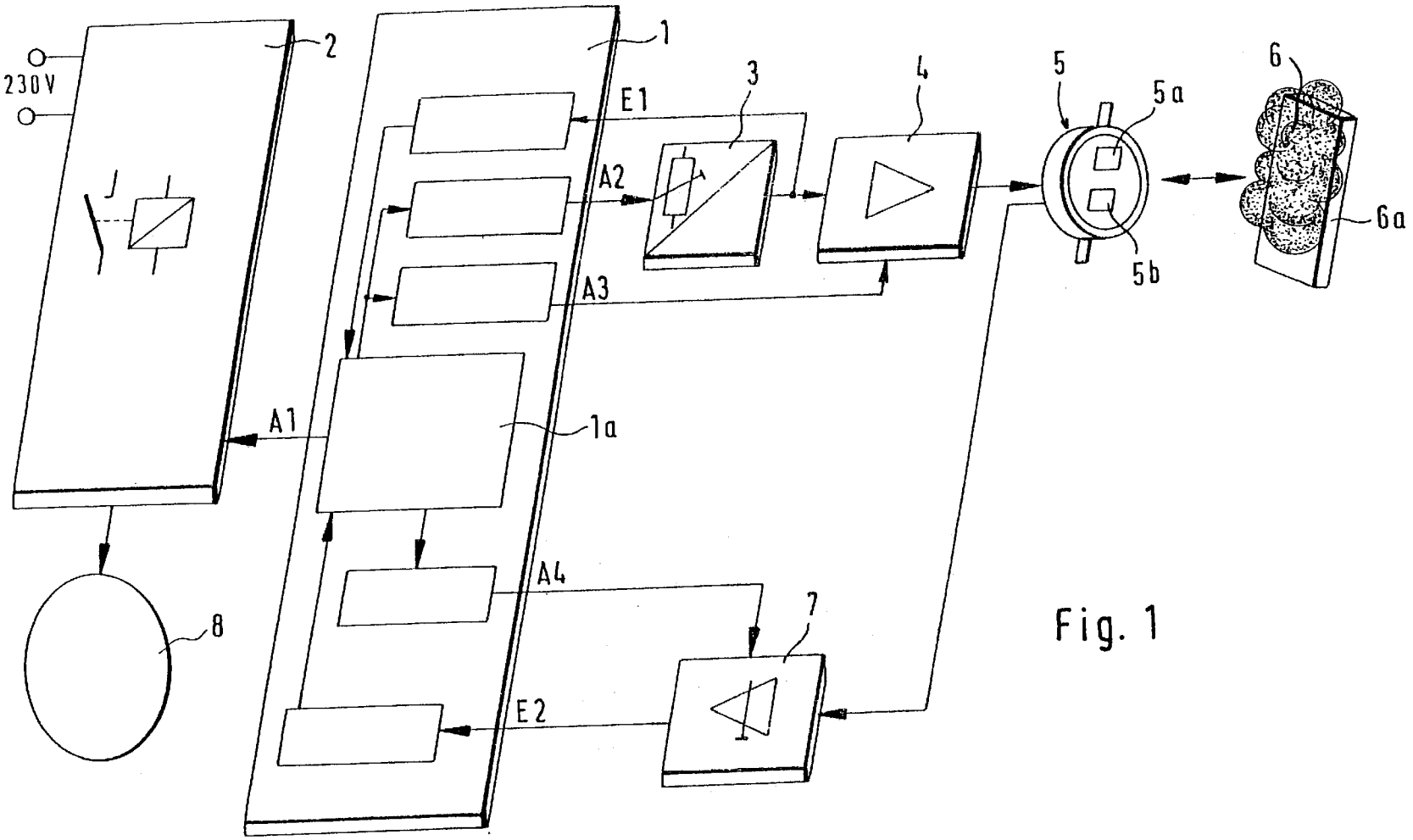
FIG. 1 shows a block circuit diagram of the monitoring circuit.

Connected to a microcontroller 1 with a microcomputer 1*a* at an output A1 is a control circuit 2 for actuating the fan motor 8 of a fumes extractor hood. The speed of rotation of the motor 8 is controlled in dependence on the vapour rising from the heated cocking (not shown). The control circuit 2 receives from the microcomputer 1*a* the presetting factor as to what speed of rotation is associated with what amount of rising vapour.

Connected on the output side of the microcontroller 1 at an output A2 is an oscillator 3 and connected on the output side of the oscillator 3 is a sensor actuation means 4. The output signal of the oscillator 3 is fed back to an input E1 of the microcontroller 1 and there permits measurement of the output frequency at the oscillator. The sensor actuation means 4 receives by way of a second input which is connected to the output A3 of the microcontroller 1 a switching signal which implements switching over between the transmitting and the receiving mode of a downstream-connected ultrasound sensor 5. The ultrasound sensor 5 is installed at a suitable location in a fumes extractor hood and senses in a reflection procedure by way of the reflector 6*a* the vapour 6 which rises from the cooking (not shown). Fitted in the ultrasound sensor 5 are a transmitter 5*a* and a receiver 5*b* which in operation thereof are switched on alternately by the sensor actuation means 4.

The signal from the receiver 5*b*, the so-called echo signal, arising out of reflection at the vapour 6, is passed to the input of an amplifier 7 which is connected to an input E2 of the microcontroller 1. Signal gain is adjusted at the amplifier 7 by way of an output A4 of the microcontroller 1.

Figure 2:
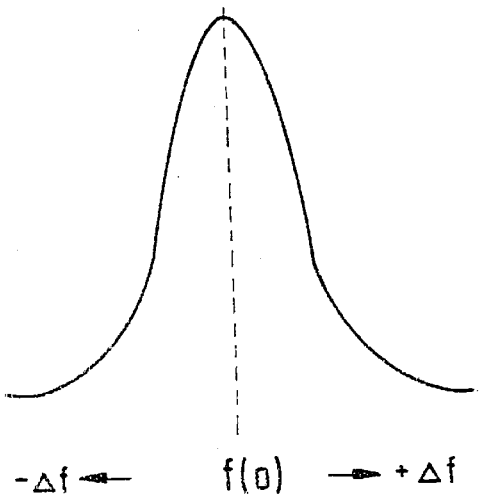
FIG. 2 shows the resonance curve of a ultrasound sensor.
Figure 3:
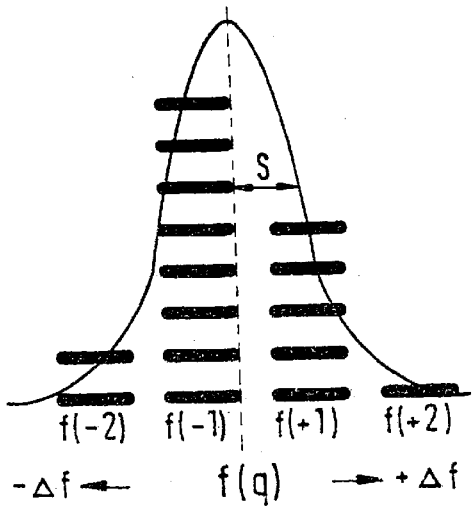
FIG. 3 shows the frequency of measured individual frequency values at predetermined locations in the region around the resonance frequency.

FIG. 2 shows the resonance curve f (o) of an ultrasound sensor 5. The typical resonance frequency of a sensor of that kind is 200 kHz. Due to the above-mentioned drift, triggered off by changes in temperature or by ageing of the sensor, the resonance curve can be shifted in the direction of lower or higher frequencies. The core problem of the invention is to compensate for such shift and always to operate the ultrasound sensor 5 with the resonance frequency which is in fact specified.

Establishing that deviation from the resonance frequency f (o) is effected in a short time repeatedly in a cyclic procedure during operation of the ultrasound sensor when monitoring the vapour 6. For that purpose the actuation frequency for the ultrasound sensor is altered by adjustment of the oscillator 3 in an operation of passing a plurality of times through the frequency range below and above the resonance frequency. For that purpose the oscillator is detuned increasingly in the direction of lower frequencies and then in the direction of higher frequencies, than the resonance frequency. In that procedure, in each case the amplitude maximum of the echo signal is measured by way of the amplifier 7. That procedure is repeated a plurality of times. The number of amplitude maxima which are measured at −1 kHz and +1 kHz respectively is stored. The same applies in regard to the frequency −2 kHz and +2 kHz respectively in relation to the resonance frequency. That procedure affords a number of one or more frequency values which are associated with amplitude maxima. If the number were equal for measurements above and below the resonance frequency, the new centre frequency would also precisely correspond to the original resonance frequency. If however that is not the case, then in the operation for statistical evaluation of that number the centre frequency is shifted in that direction where the larger number of individual values was measured. The centre frequency f (q) therefore differs somewhat from the original resonance frequency f (o). That frequency f (q) is defined as a new resonance frequency of the ultrasound sensor and the oscillator 3 is used until the next compensating procedure as the new resonance frequency f (o).

Calculation of the new centre frequency f (q) is effected in accordance with a statistical evaluation process by way of calculation of the standard deviation. The nature of that statistical evaluation is to be considered as a possible way of calculating that centre frequency. The invention is not limited to the use of that calculation process.

What is claimed is:

1. An ultrasonic sensor for a fumes extractor hood with automatic compensation regarding temperature and ageing drift, said ultrasound sensor possessing a system-specific resonance frequency and comprising a transmitter and a receiver for monitoring rising cooking vapors conveyed to said fumes extractor hood; an electronic monitoring circuit which, at predetermined time intervals during operation of the ultrasound sensor (5), causes a frequency band of the transmission signals to sweep in the region around the resonance frequency f(o) towards both sides thereof, said monitoring circuit measuring the maximum amplitudes of generated reception signals so as to form an average frequency f(q) from the therewith associated frequencies, and utilizes said average frequency f(q) as a resonance frequency f(o) for the sensor until a successively determined change in the average frequency f(q).

2. An ultrasound sensor according to claim 1, wherein the monitoring circuit upon passing through the frequency band determines and stores frequency values which are associated with said encountered maximum amplitudes, said monitoring circuit calculates from a frequency distribution of the respective maximum amplitudes and the therewith associated frequency values, in a statistical calculation process, a standard deviation and the average frequency f(q), and utilizes said average frequency as a resonance frequency for the operation of the sensor until the successively determined change in the average frequency f(q).

3. An ultrasound sensor according to claim 2, wherein for determining the standard deviation and the average frequency f(q), said monitoring circuit stores only those frequency values which are at a predetermined frequency spacing relative to the resonance frequency f(o), at a range of about ±1 kHz and ±2 kHz.

4. An ultrasound sensor according to claim 1, wherein the monitoring circuit implements a cyclical drift compensation for presently a short period of time and effectuates monitoring of the cooking vapors (6) during the remaining periods of time.

5. An ultrasound sensor according to claim 1, wherein said ultrasound sensor has a housing containing said transmitter **(5*a*) and said receiver (5*b*), said sensor being alternatingly operative in a transmitting and in a receiving mode; and a reflector (6*a*)** for said vapor enabling said sensor to sense said vapor through a reflection process.

6. An ultrasound sensor according to claim 1, wherein that the monitoring circuit comprises selectively a microcontroller or ASIC (1) which facilitates control of a ventilating fan of the fumes extractor hood and which provides for automatic ageing drift compensation.

7. An ultrasound sensor according to claim 6, wherein an adjustable oscillator (3), a sensor actuation circuit (4) and the ultrasound sensor (5) are connected downstream of the microcontroller (1), and said ultrasound sensor outputs the reception signal thereof to an A/D-converter in the microcontroller (1).

8. An ultrasound sensor according to claim 7, wherein the oscillator (3) and the sensor actuation circuit (4) are constituents of the microcontroller.

* * * * *